US006207037B1

(12) United States Patent
Dartnell et al.

(10) Patent No.: US 6,207,037 B1
(45) Date of Patent: Mar. 27, 2001

(54) RECOVERY OF METAL FROM SOLUTION

(75) Inventors: Nicholas J. Dartnell, Harrow; Christopher B. Rider, New Malden, both of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/351,824

(22) Filed: Jul. 12, 1999

(30) Foreign Application Priority Data

Jul. 13, 1998 (GB) ..... 9815168

(51) Int. Cl.[7] ..... C25B 15/02

(52) U.S. Cl. ..... 205/337; 204/228.1; 204/229.8; 204/229.9; 204/218; 204/230.1; 204/230.2; 204/230.7; 204/434

(58) Field of Search ..... 205/337, 82, 83, 205/96, 101, 263, 228.1; 204/229.8, 229.9, 218, 230.1, 230.2, 230.7, 434

(56) References Cited

U.S. PATENT DOCUMENTS

| | | | | |
|---|---|---|---|---|
| 3,925,184 | | 12/1975 | Cave | 204/229 |
| 3,980,538 | | 9/1976 | Higgins | 204/109 |
| 4,018,548 | | 4/1977 | Berkowitz | 418/61 A |
| 4,018,658 | * | 4/1977 | Alfin et al. | 204/228.1 |
| 4,619,749 | | 10/1986 | Nusbaum | 204/228 |
| 4,776,931 | | 10/1988 | Hardy | 204/105 R |
| 5,310,466 | | 5/1994 | LaRiviere et al. | 204/228 |
| 5,951,842 | * | 9/1999 | Ueffinger | 205/337 |

FOREIGN PATENT DOCUMENTS

| | | |
|---|---|---|
| 0 201 837 | 11/1986 | (EP) . |
| 0 598 144 A1 | 5/1994 | (EP) . |
| 0 754 780 A1 | 1/1997 | (EP) . |
| 1 500 748 | 2/1978 | (GB) . |

* cited by examiner

*Primary Examiner*—Bruce F. Bell

(57) ABSTRACT

Recovery of silver from a photographic fixer solution in an electrolytic cell is controlled so as to maintain a high current efficiency whilst minimizing unwanted side effects. The difference between plating voltages when operating at two different current levels is monitored, and the plating current adjusted in response to detection of a maximum of said differences. Such control allows the cell to be operated continually at high current efficiency in response to changing chemical conditions within the cell.

13 Claims, 3 Drawing Sheets

RECOVERY OF METAL FROM SOLUTION

FIELD OF THE INVENTION

The present invention relates to a method of, and apparatus for, controlling the recovery of metal from solution in an electrolytic cell by plating, (or deposition), onto an electrode thereof. The invention finds particular, though not exclusive, application in the recovery of silver from a photographic solution.

BACKGROUND OF THE INVENTION

For convenience the invention will be discussed, by way of example only, with reference to photographic solutions used in black and white processing.

Photographic material, in sheet or roll film form, is processed in several stages, including chemical development, fixing of the image, washing and drying. The role of the photographic fixing solution is to form soluble salts of any unexposed silver halide grains in the emulsion of the sensitized material. As more film is processed, the fixing solution becomes seasoned with soluble silver ion complexes. These complexes reduce the ability of the solution to fix the image, and may affect its final quality. Ultimately, in some instances the solution could become too loaded with silver and it would be necessary to replace it with a totally fresh solution. However, environmental legislation is increasingly putting stricter limitations on the disposal of waste material bearing silver. Consequently, attention is increasingly being paid to safe and efficient recovery of the silver, and it is known to do this electrolytically, either by recovery of silver from the effluent, which is then disposed of, or by in-line treatment in which silver-bearing solutions are withdrawn from a processing tank, passed through the electrolytic cell and returned to the tank. The advantages of in-line electrolytic recovery of the silver include:

(i) the lifetime of the fixing solution can be extended, (ii) the rate of fixing of the image can be increased, (iii) the rate of replenishment of the solution with fresh chemicals can be reduced, (iv) treatment of the effluent from the photographic processing is facilitated, (v) the value of the silver recovered is economically worthwhile, and (vi) reduced carryover of silver into the wash, with consequent lower silver concentration in the wash effluent.

As with any electrochemical process, however, poor control of the recovery of silver can do more harm than good. When a silver recovery cell is operated efficiently, the only cathodic reaction that occurs is the reduction of silver ions to silver metal, and this is controlled by the potential at this electrode. If too high a potential is applied, then side reactions can occur which lead to the production of unwanted by-products, for example silver sulphide can be formed as a fine precipitate in the solution (sulphiding). The recovery of the silver is often, therefore, a compromise between high rates of silver plating at higher currents, and consequentially at higher potentials, and safe operation. Large scale silver recovery units commercially available employ a third electrode (most commonly a reference electrode, but it may be a pH electrode) or a silver sensor, in order to maintain the efficiency of the operation and to avoid unwanted side reactions. However, these components increase the cost, and problems can arise with calibration of the equipment and electrical drift of the settings. It is possible, however, with the reference electrode, for example, to limit the cathode potential such that the potential for the formation of silver sulphide is not exceeded under any operating condition. EP-B-0598144 employs a third, pH, electrode and the potentials of the three electrodes are controlled so as to avoid sulphiding. In addition to the disadvantage of cost of such a three-electrode system, the maximum rate of removal of silver is itself limited by the fact that the potential of the cathode is kept constant.

The generally cheaper two electrode control system relies on a knowledge of the cell currents and voltages to control the process. The most common method is to use a threshold level beyond which (above which for voltage, or below which for current) it is deemed no longer suitable to recover further silver. For example, when silver is recovered at a constant current, the plating voltage rises as the concentration of the silver in the solution falls—the voltage is reflecting both a change of conductivity in the solution and a change of the potentials of the cathode and anode. A disadvantage to this control method is that the threshold level that is chosen for switch off is not necessarily a suitable or even safe level for switching off under all operating conditions. This problem is exacerbated by the fact that each processor to which silver recovery is attached has a specific combination of operating parameters reflecting the variability in the concentration of the constituents of the solution arising from variation in:

(i) film exposure, and thus the proportion of silver that is removed by the fixer, (ii) film type, and thus the quantity of silver (the coated mass) available for development and fixing, (iii) film throughput, i.e. how much film is processed per hour, (iv) processor type, and thus (a) the amount of solution that is carried into the fixing stage from the preceding development stage, and (b) the amount of oxidation that takes place, (v) the chemical composition of replenisher solution used in the various stages of the processing, and (vi) the rate at which the processing solutions are replenished.

The specific combination of the above variables used by the operator of a given processing system is known as the 'operator profile'.

The voltage necessary to supply a certain current through a fixer solution at a given silver concentration, for example, will depend strongly on the pH of the solution, the concentration of the sulphite and/or thiosulphate in the solution, the temperature of the solution, and the rate at which it flows through the cell.

U.S. Pat. No. 4,619,749 overcomes the problems associated with setting reference voltage control thresholds which are valid for a wide variety of different solutions, by using calibration solutions with high and low silver concentration. The disadvantage of this approach is that the operator must obtain the reference solutions that are characteristic of his normal operating conditions, and then perform the calibration. GB-A-1500748 overcomes the problems associated with solution variability and the choice of suitable operating conditions common to two electrode systems, by employing a second electrolytic cell as a reference. The disadvantage of such a control system, however, is that it is inconvenient for the operator to use since the test cell has to be set up and employed for every solution from which it is desired to remove the silver. U.S. Pat. No. 3,925,184 employs a work counting method, which takes account of the silver entering the system as a result of film input and the silver leaving the system through plating reactions. The silver ion concentration in the fixer solution is estimated and a suitable current, based on a known relationship, is applied to the electrolytic cell. The disadvantage of this control method is that the amount of silver entering into the system has to be known accurately. In U.S. Pat. No. 3,980,538, a similar work counting method is employed in which the magnitude of the control current in the electrolytic cell is governed by the amount of charge on a capacitor that is intended to correspond to the quantity of silver present in the solution.

U.S. Pat. No. 4,776,931 discloses recovering metals from solutions by applying an intermittent plating voltage until the current drawn by the solution exceeds a predetermined threshold value above which the recovery system operates. U.S. Pat. No. 5,310,466 similarly operates using threshold values. Each of these systems has the disadvantages set out above of variability introduced by the operator.

U.S. Pat. No. 4,018,658 discloses a silver recovery system in which the voltage across the electrodes and the current passing between them are monitored, and the voltage is adjusted using a feedback loop so as to achieve the optimum current density. The system employs a predetermined voltage-current characteristic and is thus not able to adapt to any variation in the solution of the electrolytic cell.

EP-A-0201837 discloses a silver recovery process in which the electrolytic cell is operated at the plateau of the potential difference/current curve, that is to say at that point where the current is determined by the speed of diffusion of silver to the cathode surface. EP-A-0754780 is said to be an improvement on this system, in which that condition, referred to as the diffusion limitation current, is ascertained and the cell is then operated at a current density which is lower than the diffusion limitation current density. Amongst the ways proposed to determine the diffusion limitation current density, is mentioned the periodic measurement of a current-potential characteristic of the cell at a given silver concentration under de-silvering conditions. One such characteristic, although not a preferred one, is specified as being the curve of current versus the potential difference between the anode and the cathode, with a diffusion limitation current being determined by identifying the cell current when the second derivative of the current-potential characteristic is zero and the first derivative is minimal. The disadvantage of this system is the difficulty of obtaining a sufficiently accurate measurement of the diffusion-limited current by such a method.

Applicants have realized that there is a requirement for a method of recovering metal from solution under more controlled conditions, and in particular whereby high current densities may be sustained for the longest times without unwanted side reactions. Furthermore, it is desirable to be able to maintain improved control of metal removal, that is to say to maintain recovery of the metal at high current efficiency, in operation even when the chemical conditions within the cell are changing. That is to say, it is desirable to provide a control method that can continually adapt to changes that are taking place in the cell.

It is also desirable to remove metal from solution without requiring the presence of a control electrode.

SUMMARY OF THE INVENTION

In accordance with one aspect of the present invention, there is provided a method of controlling the recovery of metal from solution in an electrolytic cell containing a cathode and an anode by deposition onto the cathode thereof as a plating current flows through the cell between the cathode and the anode under the action of a plating voltage thereacross, comprising the steps of:

repeatedly monitoring (a) the difference between voltages measured across the cathode and anode at a first current level and at a second current level, or (b) the difference between currents flowing between the cathode and anode at a first voltage level and at a second voltage level; and modifying said plating voltage and/or plating current in response to the change in said difference arising from variation in the concentration of metal in the solution, thereby to control recovery of the metal from the solution.

The monitoring may be carried out in real-time, or by reference to stored values.

Preferably, only if it is known that the concentration of the metal in the cell is increasing, the second current or voltage level will be selected so as to be higher than the plating current or plating voltage respectively.

Advantageously, one of said current or voltage levels corresponds to the plating current or plating voltage respectively.

It is to be understood that the difference between the monitored voltages or currents may result in a modification so as to switch on the plating current or voltage from a previous zero level, in other words, so as to initiate deposition of the metal.

Preferably, the plating voltage and/or plating current is modified in response to detection of said difference reaching a maximum value.

Preferably the rate of flow of the solution through, and/or the temperature of the solution in, the cell is monitored, and the value of the current or voltage as measured is adjusted in accordance with variation of the rate of flow and/or temperature.

Control of recovery of metal may be delayed until solution has been flowing through the cell for a predetermined time.

A probe current may be repeatedly passed through the solution, and in the event of any decrease being noted in the voltage across the cell, said control of metal recovery may be initiated.

A probe voltage may be repeatedly applied to the cell electrodes, and in the event of an increase being noted in the current flowing through the solution, said control of metal recovery may be initiated.

It is to be understood that the terms 'plating current' and 'plating voltage' refer respectively to currents and voltages that are present in the cell over a relatively long period of time and are thus the usual operating values that exist in the cell. In contrast, the first level, second level, and probe currents and voltages are short term values that are temporarily applied to the cell for monitoring purposes only.

In a preferred method, the metal is silver and is recovered from a black and white photographic processing solution, for example a fixer solution, in the cell. It is to be appreciated, however, that the control of metal recovery in accordance with the present invention can be used not only with respect to black and white photographic processing solutions but also may be applicable to silver-containing processing solution or effluent from color photographic processing solutions. With color photographic processing solutions, for example, a metallic species, such as iron, may be present in addition to the silver which it is desired to remove by deposition. Should the presence of another metallic species tend to interfere with the removal of a particular species by the method of the present invention, then measures will have to be taken to avoid, to eliminate, or otherwise to take into account the effect of that species.

In accordance with another aspect of the present invention, there is provided apparatus for controlling recovery of metal from solution, wherein the solution is contained in an electrolytic cell having an anode and a cathode, wherein the metal is arranged to be deposited onto the cathode as a plating current flows through the cell between the cathode and the anode under the action of a plating voltage thereacross, comprising means for repeatedly monitoring (a) the difference between voltages measured across the cathode and anode at a first current level and at a second current level, or (b) the difference between currents flowing between the cathode and anode at a first voltage level and at a second voltage level; means for modifying said plating voltage and/or plating current in response to said difference; and means for controlling operation of the monitoring means and the modifying means.

The apparatus may comprise means for probing conditions within the cell so that the monitoring and modifying of its operation takes place only under certain conditions.

The control over recovery of metal from solution in accordance with the present invention allows recovery at high current efficiency to be maintained under changing chemical conditions within the cell. In general the current efficiency, $\epsilon$, of a metal recovery reaction in an electrolytic cell may be defined as follows $$\varepsilon = \frac{\text{No. of moles of metal recovered} \times \text{No. of electrons transferred in the reaction}}{\text{No. of Faradays of charge passed}}$$

and therefore $$\varepsilon = \frac{nF(C_t - C_o)V}{MIt}$$

where n: The number of electrons transferred during reaction

F: Faraday's constant $C_t$: The concentration of metal species at time t $c_o$: The concentration of metal species at the start of the recovery process V: The volume of the solution M: The molar mass of the metal I: The recovery current t: The recovery period Thus, by utilizing the method of the invention, the operating condition of the electrolytic cell is noted at which it begins to lose its efficiency in recovering the metal from the solution. The current and/or voltage applied to the cell can then be appropriately adjusted so as to return the operating condition towards maximum current efficiency, so as to ensure this condition is maintained for as long a time as possible. This can be achieved for any particular processing profile adopted by an operator, can be carried out inexpensively and conveniently using only a two electrode arrangement, and, in the case of photographic solutions, can avoid sulphiding. Furthermore, this results in improved convenience of operation since the problems of electrical drift and fouling associated with three-electrode systems, and which would require the recalibration or replacement of any ancillary electrodes, are avoided.

BRIEF DESCRIPTION OF THE DRAWINGS

Methods of and apparatus for controlling the recovery of silver from a photographic fixing solution in an electrolytic cell, will now be described, by way of example, with reference to the accompanying drawings, in which.

DETAILED DESCRIPTION OF THE INVENTION

Figure 1:
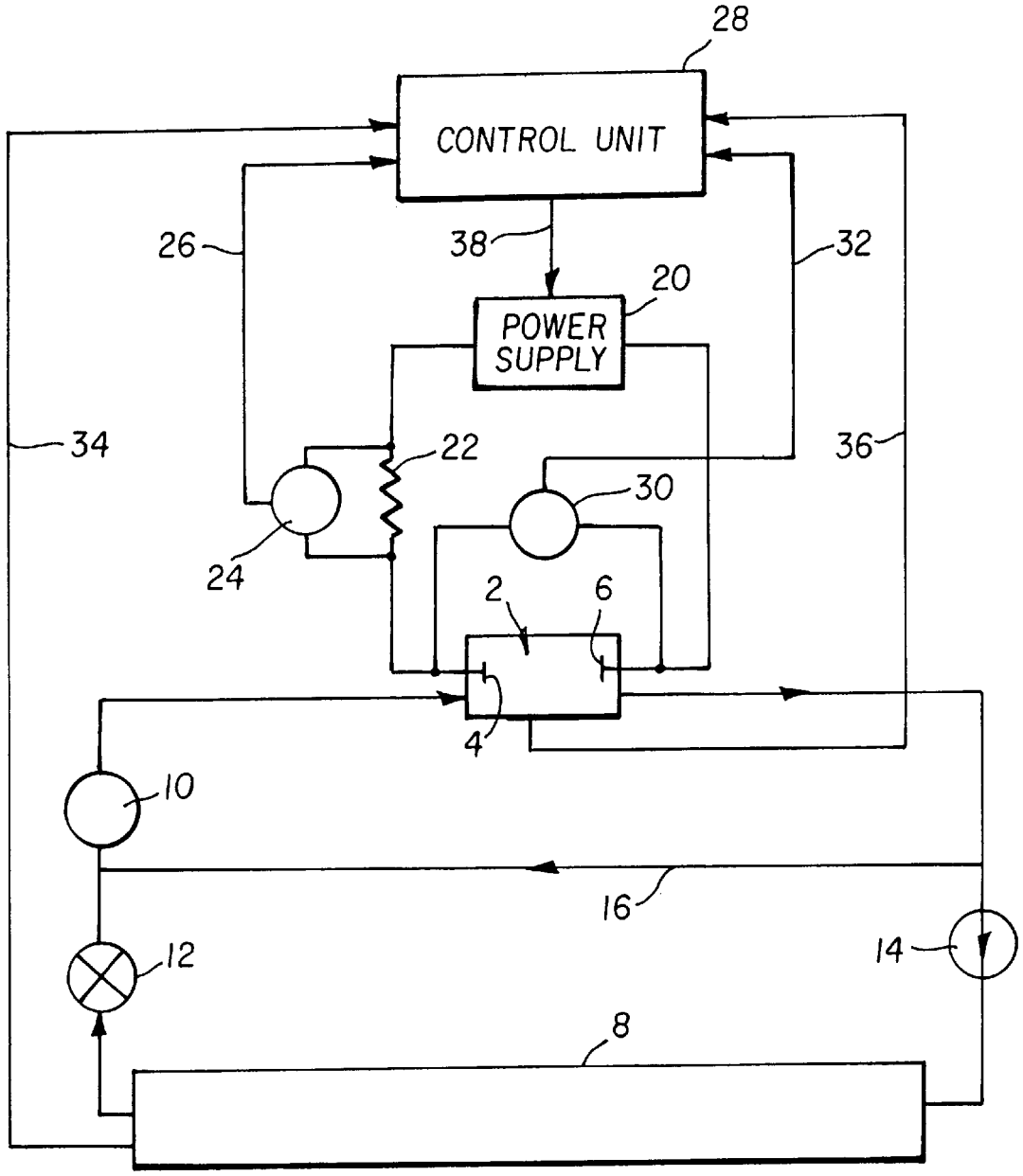
FIG. 1 is a schematic drawing of the cell and its associated electrical circuitry.

Referring to FIG. 1, an electrolytic cell 2 has an anode 4 and a cathode 6 of significantly larger surface area. Photographic fixer solution from a processing tank 8 is circulated through the cell 2 by a pump 10. The liquid flow between the tank 8 and the cell 2 can be isolated by means of a solenoid valve 12, a non-return valve 14 and a bypass pipe 16.

A constant current power supply 20 supplies power to the electrodes 4, 6 of the cell 2 via a measuring resistor 22 of known value. A voltmeter 24 is connected across the ends of the resistor 22 and sends a signal along line 26, representative of the current flowing through the cell 2, to a control unit 28. A voltmeter 30 is connected externally of the cell 2 across its electrodes 4 and 6, and sends a voltage signal along line 32 to the control unit 28. The control unit 28 also receives information along a signal line 34 from the fixer tank 8, and along a signal line 36 from the cell 2, representative of conditions therein. The control unit 28 sends control signals along line 38 to the power supply 20.

Figure 2:
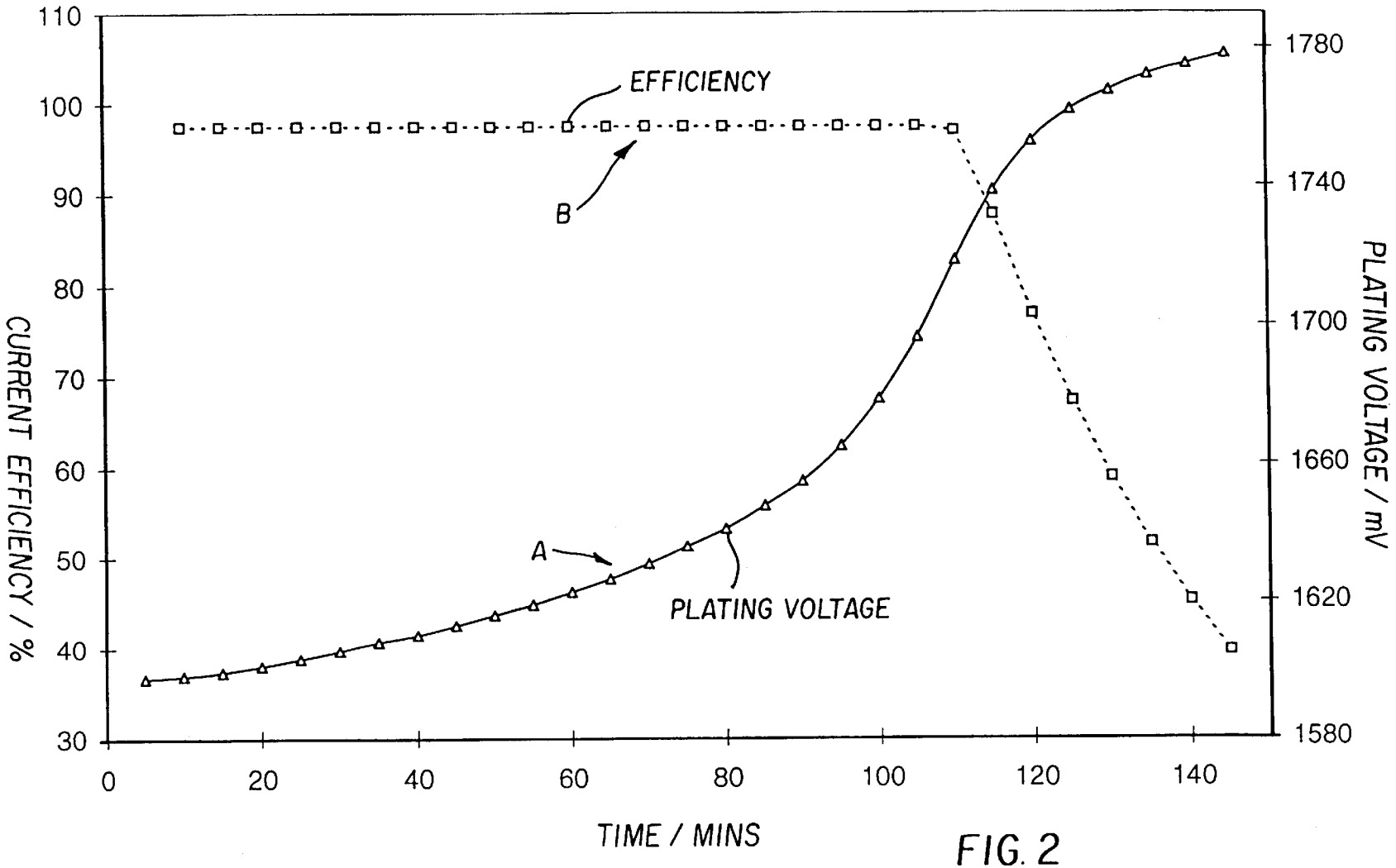
FIG. 2 is a graph showing a portion of curves of plating voltage and current efficiency versus time for the de-silvering of a seasoned black and white fixer solution.
Figure 3:
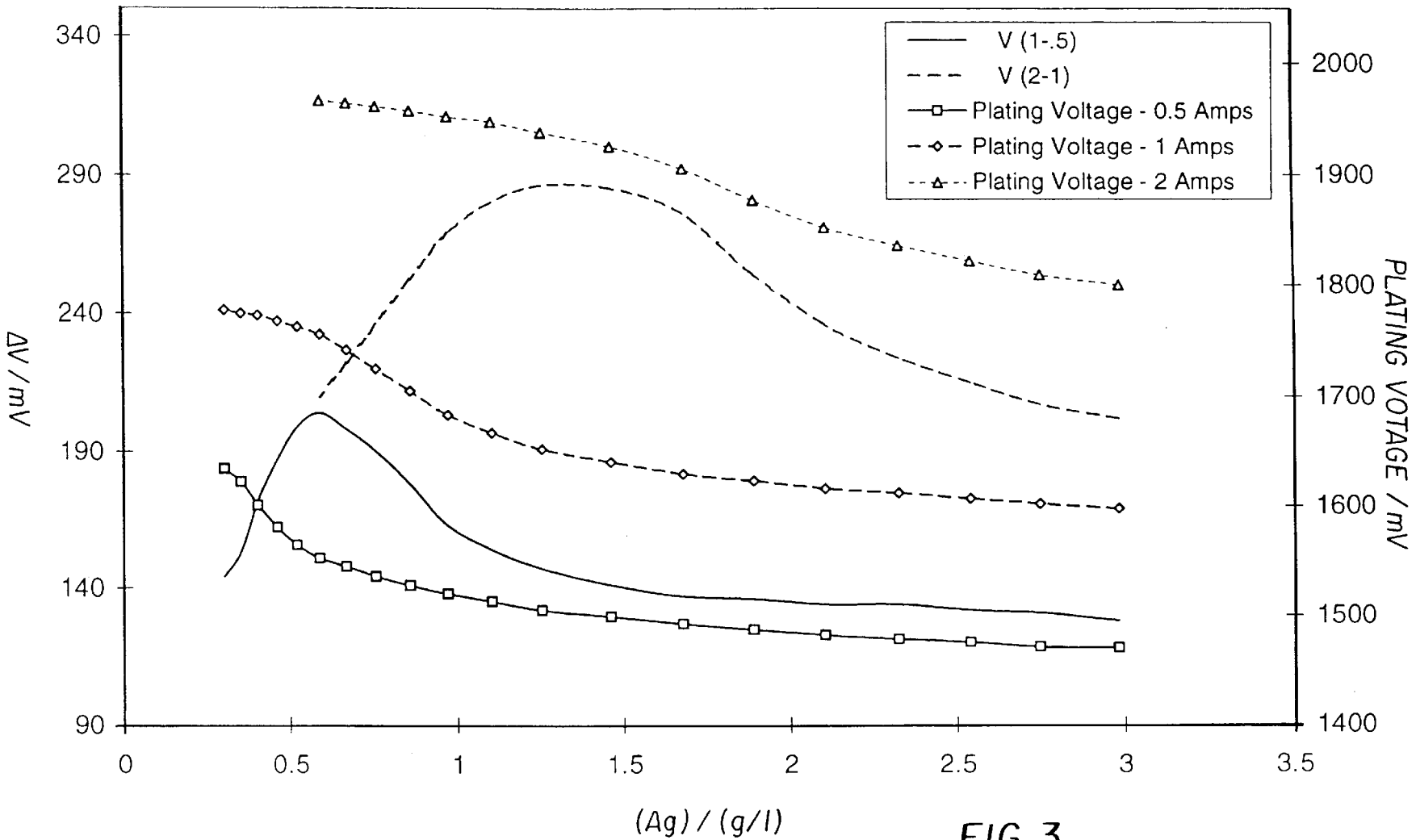
FIG. 3 is a graph showing curves of plating voltage, $\Delta V$, at different levels of plating current and the corresponding voltage difference curves, $\Delta V$, between two adjacent levels, versus silver concentration for the de-silvering of three identical batches of black and white fixer solution at various levels of constant current.

The curves of FIGS. 2 and 3 represent conditions in which no film is being processed nor replenisher added.

FIG. 2 shows a portion of the curves of plating voltage A and current efficiency B versus time, for the de-silvering of a seasoned black and white fixer solution from the tank 8 as measured in the cell 2 at a constant current of 1 A. As silver is recovered from the fixing solution in the cell 2 on to the cathode 6, and thus as the concentration of silver in the cell 2 falls, a transition point is reached below which the current efficiency is reduced. The cell 2 is thus no longer operating at high current efficiency. The point at which the current efficiency starts to fall occurs at the inflection point of the Curve A, that is to say at the point of maximum rate of change of the voltage across the electrodes 4, 6 of the cell 2.

The point of inflection in the voltage versus time curve A of the FIG. 2 is related to the silver concentration and to the plating current. Under otherwise constant conditions, the point of inflection, and therefore the point of loss of efficient plating, is observed at lower silver concentrations for lower plating currents. A further embodiment of the recovery method of the present invention will now be described with reference to FIG. 3. FIG. 3 shows a first set of curves C, D and E plotted against silver concentration (in grams per liter) of the voltage across the cell 2 for the de-silvering of three identical batches of seasoned black and white fixer solutions at constant currents of 0.5 A (curve C), 10 A (curve D) and 2.0 A (curve E) respectively. FIG. 3 additionally shows a curve J that relates the silver concentration, (in grams per liter) and the voltage difference between operating the cell 2 at constant currents of 2 A and 1 A. FIG. 3 also shows a similar curve K, which is the voltage difference between operating the cell at constant currents of 1 A and 0.5 A. The voltage difference between the two levels (ΔV) is monitored during plating at one current level by making repeated short probe measurements at the second level. By modifying the plating current when the maximum value of ΔV is reached, it can be ensured that the cell 2 is operated in a mode in which the silver is recovered rapidly and at high current efficiency. If the silver concentration is increasing, as the maximum is reached, the plating current is increased to recover the silver more rapidly. If, however, the silver concentration is decreasing as the maximum is reached, the plating current is reduced to maintain high current efficiency. The peak of the curves J and K tend to occur at a concentration of silver in the fixer solution which is mid-way between the concentrations at which the inflections in the voltage curves A are observed for the higher and lower constant currents. It is the difference in position of those inflection points that gives rise to the occurrence of a peak in the ΔV (J, K) curve. The control unit 28 is thus arranged to respond to the peak in the J, K curve in order to adjust the current through the cell 2 to a higher or to a lower level, or to turn on or to turn off the plating process at the start or the end of the silver recovery operation.

The control method described with reference to FIG. 3 may be carried out even while the silver concentration is changing, due to the processing of film or to the addition of replenishment solution to the processing tank, since the measurements are made over a time scale that is small compared with that taken for any significant change to take place in the chemical composition. It is not possible to determine from changes in the ΔV values alone whether the silver concentration is increasing or decreasing since the peak is approximately symmetrical and may be approached from either side. When combined with information relating to the changes in the plating voltage, it is possible to determine unambiguously whether silver concentration in the tank is increasing or decreasing as the maximum value of ΔV is reached and hence whether the plating current should be reduced or increased. The determination of the direction of changes in silver concentration is valid whether or not the silver concentration is changing due to desilvering, or processing of film or dilution as a result of replenishment of the associated photoprocessing tank.

A preferred method of controlling silver recovery in accordance with detection of the peak of the ΔV curves (J, K) is to combine operation of the cell 2 at given constant current plating level with short periods of time of probing at a higher or lower current level, in order to assess whether it is necessary to change the level of the constant plating current. Furthermore, by constantly monitoring the plating voltage, the direction of change of the silver concentration is determined. For example, if at a constant current, the plating voltage is decreasing but the ΔV value is increasing, then the silver concentration must be increasing and is approaching the silver concentration at which the peak in the ΔV curve occurs from a situation of lower silver concentration. On the other hand, if the plating voltage at constant current is decreasing but the ΔV value is also decreasing, then we may deduce that the silver concentration at which the ΔV peak occurs must have been exceeded. Therefore, by arranging for the control unit 28 repeatedly to note and to store the plating voltage and the ΔV values under conditions of switching between the plating current and a probe current, the unit 28 will contain information from which it can be determined which side of the peak of the ΔV (J, K) curve the silver concentration lies. The control unit 28 can then decide whether it has to increase or to decrease the current through the cell 2 when the maximum value of ΔV has been detected. Upon initial start up of silver recovery in the cell 2, when the plating current is zero, the switching is made between two probe current levels, carried out periodically, until it is ascertained that the silver concentration has reached a high enough level so that it is safe to apply a continuous plating current.

This invention thus allows the plating current, or voltage, to be operated with high current efficiency and rapid recovery rates, avoiding unwanted side reactions such as sulphiding, by arranging for the current, or voltage, to be increased or decreased in order to maintain efficient recovery of metal from the solution and ultimately of being switched off when that can no longer safely and conveniently be sustained.

Once a peak in the plating voltage difference (ΔV), or in the plating current difference (ΔI), has been found, the values of the plating voltage and current at the peak position can be stored in computer memory as a look-up-table (LUT). These values can now be used as "threshold" levels by the control system, the benefit being that the threshold has been derived for the specific solution and flow conditions present in the cell.

For example, consider the desilvering at an initial constant current of 0.5 A of a batch of fixer of the type used in FIG. 3, whose initial silver concentration is 0.4 g/l, in the situation where the silver concentration is rising due to the processing of film. As silver is introduced to the solution, the silver concentration rises, the plating voltage at 0.5 A (curve C) falls and $\Delta V_{1-0.5}$ (curve J) rises up to its maximum value at 0.6 g/l.

When the maximum value is detected, the value of the plating voltage (1.551V) and current (0.5 A) are stored in the LUT. The plating current is then increased to 1 A to improve the recovery rate whilst maintaining high plating efficiency. After a short period in which initial switching transients are allowed to settle, the new plating voltage is determined to be 1.754 V. The new values of plating current and voltage corresponding to the silver concentration at which $\Delta V_{1-0.5}$ is a maximum are also stored in the LUT. These values are specific to the actual solution component concentrations, flow conditions and temperature that were present when the peak was detected.

The stored values may be used subsequently for increasing and decreasing the plating current without the need to actually monitor and detect the maximum value of the $\Delta V_{1-0.5}$ curve. For example, the plating voltage and current might be 1.65 V and 1 A respectively when film processing is halted. The silver concentration in the tank now decreases under the action of the silver recovery system and so causes the plating voltage to increase (see curve D). When the voltage exceeds 1.754 V, the value in the LUT corresponding to the silver concentration at which the $\Delta V_{1-0.5}$ peak occurs, the plating current is reduced to 0.5 A to maintain high current efficiency. If desired in the above example, it is possible to reduce the plating current before the plating voltage exceeds 1.745 V to gain a small improvement in overall current efficiency at the expense of reduced recovery rate.

The LUT may be further used to store values of ΔV for a given plating current (or ΔI for a given plating voltage) against plating voltage (or plating current respectively). This information enables more accurate determination of the position of the peak by using curve fitting and more sophisticated peak detection algorithms. It also permits, based on past knowledge of the curve shape, the prediction of peak position in advance of reaching it, so that, in cases of reducing silver concentration, the plating current may be reduced before the peak is passed. This approach ensures that plating at high current efficiencies is maintained without compromise by the requirement of having to pass the peak in order to detect it in real-time.

The values of plating current and voltage stored in the LUT should be regularly updated to follow the changing solution concentrations in the tank and flow conditions in the cell due to tank seasoning effects, variation in parameters of the operator profile and due to increasing silver thickness on the cathode. In this way, the "voltage or current threshold levels" stored in the LUT are optimized to match changing solution and cell conditions.

Furthermore, another location in the LUT may be used to store the last known values of plating current and voltage. With this information, the LUT may also be used to detect sudden changes in plating conditions as might occur for example when a tank is drained and filled with fresh solution. Normally, the silver recovery unit would be switched off during draining and refilling of a tank. In this case, when the silver recovery unit is next switched on, the plating voltage at the same plating current last used before switch off would not correspond to the last known plating voltage. The control system would then reset all the values stored in the LUT and build it up again over time as the silver concentration in the tank permits the use of the whole range of plating current bands.

It has been found that although control of the recovery of metal from a solution in accordance with the invention can be carried out over a wide range of flow conditions, higher flow rates are preferred. The higher the flow rate, the better is the agitation of the solution in the cell 2, especially at the boundary layer of the cathode 6. Thus, by employing higher flow rates for metal recovery at a given current, the concentration of the metal can be reduced to a lower level at high current efficient recovery.

Furthermore, it has been found that using solutions having a higher pH value, a greater dynamic range is obtained in the curve of the change of the voltage, or current versus time, and the peak is of a greater height for a common background level.

Furthermore, the position of the peak is also affected, and is shifted to lower metal concentrations as the pH value increases. Use of a higher pH solution in the electrolytic cell 2 thus allows the metal to be recovered down to lower concentrations without loss of efficiency and whilst providing greater signal-to-noise ratios.

It is known that the rate of flow of the solution through the cell 2 has a great effect on the voltage that is required to be applied across the electrodes 4, 6 thereof in order to maintain the current therethrough at a constant value. Accordingly, the flow may be arranged to be monitored, by means of a flow sensor in the pipework, or by means of the back EMF of the pump 10, so that a correction can be made in the control algorithms of the control unit 28 to account for short term fluctuation in the flow rate. Similarly, the temperature of the solution affects the plating voltage in the cell 2 and corresponding corrections can be made via the control unit 28. Information in respect of these corrections may be sent from the cell 2 to the control unit 28 along the signal line 36. It will be appreciated that monitoring the temperature of the solution in the cell 2 in this way allows the control system to be operated more accurately and in particular when the photographic processor, specifically the fixer tank, has been turned off and during periods of cooling of the solution shortly after turn off.

An input signal to the control unit 28 from the photographic processor, for example along the signal line 34 from the fixer tank 8, provides extra safety for the operation of the metal recovery cell 2 when switching on or when increasing the value of the current through the cell. Such a signal will, for example, indicate that photographic material is present in the system and consequentially that it is very likely that silver has entered into the solution. When starting with a fresh fixer solution, for example, where the risk of sulphiding of the cell 2 is increased, the control unit 28 can ensure that the cell 2 is not brought into operation until at least some photographic material has been processed.

The control unit 28 can also be arranged to operate the cell 2 only after any transient behavior has taken place, for example when the system is used for the first time either with a new or silver-laden cathode, or if a change of current level is made. The accuracy and efficiency of the silver recovery is thus controlled.

As a further aid to safe operation of the recovery system, a low level probe current can be applied to the solution in the cell 2, for example of 0.25 amps, being low enough not to cause unwanted side reactions in the cell 2. Any decrease in the associated voltage across the electrodes 4, 6 of the cell 2 to maintain this current at a constant level would be indicative of the input of silver to the solution in the cell 2. If a decrease were detected in the required voltage, this could be used as a trigger for probing at higher currents to check for switch on.

If the voltage associated with the plating current is rising, then in the absence of input of silver to the system, the implication is that the silver concentration is falling and hence only probing at lower current levels is required. Conversely, if the voltage is falling then the control unit 28 can arrange for probing only at increasing current levels. By operating in this way with probe current, added safety is brought to the controlling method when the silver concentration is falling, and faster removal is achieved when the silver concentration is rising. Thus, the efficiency of silver removal by the system is enhanced.

The time between the application of current at probe level can be adapted according to the magnitude of the rate of change of the plating voltage. That is to say, a faster change in plating voltage would result in the control unit 28 applying probe currents at shorter intervals. For example, the control unit 28 can be programmed to operate such that it awaits a constant voltage change during plating (silver recovery) between probe sequences.

As a further modification of the control method described with reference to FIG. 3, when the probe conditions indicate that the plating current needs to be changed to a new level, then, particularly when the plating current is being increased, the increment can be arranged to be half the difference from the plating level to the higher probe current used. This ensures that after increasing the current the recovery of silver is being carried out efficiently at the new plating current level.

The invention has been described in detail with particular reference to certain preferred embodiments thereof, but it will be understood that variations and modifications can be effected within the spirit and scope of the invention.

We claim:

1. A method of controlling the recovery of metal from solution in an electrolytic cell containing a cathode and an anode by deposition onto the cathode thereof as a plating current flows through the cell between the cathode and the anode under the action of a plating voltage thereacross, comprising the steps of: repeatedly monitoring (a) the difference between voltages measured across the cathode and anode at a first current level and at a second current level, or (b) the difference between currents flowing between the cathode and anode at a first voltage level and at a second voltage level; and modifying said plating voltage and/or plating current in response to change in said difference arising from variation in the concentration of metal in the solution, thereby to control recovery of the metal from the solution.

2. The method of claim 1 wherein one of said current or voltage levels corresponds to the plating current or plating voltage respectively.

3. The method of claim 1 wherein the plating voltage and/or plating current is modified in response to detection of said difference reaching a maximum value.

4. The method of claim 1 wherein at least one of the rate of flow of the solution through, and the temperature of the solution in, the cell is monitored, and wherein the value of the plating current or plating voltage as measured is adjusted in accordance with variation of the rate of flow and/or temperature.

5. The method of claim 1 wherein activation of said control of recovery of metal is delayed until solution has been flowing through the cell for a predetermined time.

6. The method of claim 1 wherein a probe current of substantially constant value is repeatedly passed through the solution, and wherein in the event of any decrease being noted in the voltage between the anode and the cathode, said control of metal recovery is initiated.

7. The method of claim 1 wherein a probe voltage is repeatedly applied to the cell electrodes, and wherein in the event of an increase being noted in the current flowing through the solution, said control of metal recovery is initiated.

8. The method of claim 1 wherein the metal is silver and is recovered from a photographic processing solution in the cell.

9. The method of claim 1 wherein a signal indicative of any increase in the concentration of the metal in the solution is used to initiate the said monitoring.

10. An apparatus for controlling recovery of metal from solution, wherein the solution is contained in an electrolytic cell having an anode and a cathode, wherein the metal is arranged to be deposited onto the cathode as a plating current flows through the cell between the cathode and the anode under the action of a plating voltage thereacross, comprising means for repeatedly monitoring (a) the difference between voltages measured across the cathode and anode at a first current level and at a second current level, or (b) the difference between currents flowing between the cathode and anode at a first voltage level and at a second voltage level; means for modifying said plating voltage and/or plating current in response to said difference; and means for controlling operation of the monitoring means and the modifying means.

11. The apparatus of claim 10 comprising means for repeatedly passing a predetermined probe current through the solution, and means for monitoring the voltage between the anode and cathode, wherein said control means is arranged to activate said monitoring means and said modifying means only in response to detection of a decrease of the voltage between the anode and the cathode.

12. The apparatus of claim 10 comprising means for repeatedly applying a predetermined probe voltage between the cathode and anode of the cell, and means for monitoring the current flowing through the solution, wherein said control means is arranged to activate said monitoring means and said modifying means only in response to detection of an increase in the current flowing through the solution.

13. The apparatus of claim 10 comprising means for providing a signal indicative of an increase in the concentration of metal in the solution, and supplying the said signal to the control means.

* * * * *